US006567637B2

(12) United States Patent
Yanagisawa et al.

(10) Patent No.: US 6,567,637 B2
(45) Date of Patent: May 20, 2003

(54) APPARATUS AND METHOD FOR REPLENISHING A DEVELOPING DEVICE WITH TONER WHILE SUPPRESSING TONER REMAINING

(75) Inventors: Takaaki Yanagisawa, Tokyo (JP); Masumi Sato, Tokyo (JP); Kazuhiko Yuuki, Tokyo (JP); Akio Kosuge, Tokyo (JP); Yoshinori Ozawa, Tokyo (JP); Yoshi Hattori, Tokyo (JP); Tomotoshi Nakahara, Tokyo (JP); Kouta Fujimori, Tokyo (JP); Satoshi Muramatsu, Tokyo (JP); Junichi Matsumoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/785,234

(22) Filed: Feb. 20, 2001

(65) Prior Publication Data

US 2001/0021326 A1 Sep. 13, 2001

(30) Foreign Application Priority Data

Feb. 17, 2000 (JP) ..... 2000-039843

(51) Int. Cl.[7] ..... G03G 21/10; G03G 15/08

(52) U.S. Cl. ..... 399/258; 222/DIG. 1; 399/262; 399/359

(58) Field of Search ..... 222/DIG. 1, 167; 399/92, 93, 254, 256, 258, 260, 262, 265, 120, 123, 358, 359

(56) References Cited

U.S. PATENT DOCUMENTS

| | | | | |
|---|---|---|---|---|
| 5,386,274 A | | 1/1995 | Sanpe et al. | |
| 5,663,788 A | | 9/1997 | Sanpe | |
| 5,734,957 A | * | 3/1998 | Ogawa et al. | 399/359 |
| 5,875,380 A | | 2/1999 | Iwata et al. | |
| 5,953,567 A | | 9/1999 | Muramatsu et al. | |
| 5,960,246 A | | 9/1999 | Kasahara et al. | |
| 5,962,783 A | | 10/1999 | Iwata et al. | |
| 5,987,298 A | | 11/1999 | Muramatsu et al. | |
| 6,112,046 A | | 8/2000 | Suzuki et al. | |
| 6,128,459 A | | 10/2000 | Iwata et al. | |
| 6,142,690 A | | 11/2000 | Yoshimura et al. | |
| 6,163,669 A | | 12/2000 | Aoki et al. | |
| 6,201,941 B1 | * | 3/2001 | Kasahara et al. | 399/258 |
| 6,282,396 B1 | | 8/2001 | Iwata et al. | |
| 6,295,437 B1 | | 9/2001 | Hodoshima et al. | |
| 6,381,435 B2 | | 4/2002 | Shinohara et al. | |
| 6,393,241 B1 | | 5/2002 | Matsumoto et al. | |

FOREIGN PATENT DOCUMENTS

| | | |
|---|---|---|
| JP | 59-027558 | 2/1984 |
| JP | 4-009082 | 1/1992 |
| JP | 11-237823 | 8/1999 |
| JP | 11-282236 | 10/1999 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A toner replenishing device includes a toner conveyance path for connecting a toner storing device with a developing device, a toner conveying device for conveying the toner from the toner storing device to the developing device along the toner conveyance path, and an air supplying device connected to the toner conveyance path vie an air supply path for supplying the toner storing device with air from a bottom of the toner storing device so as to agitate the toner pooling in the toner storing device.

28 Claims, 12 Drawing Sheets

APPARATUS AND METHOD FOR REPLENISHING A DEVELOPING DEVICE WITH TONER WHILE SUPPRESSING TONER REMAINING

CROSS REFERRENCE TO RELATED APPLICATION

This application claims priority under 35 USC §119 to Japanese Patent Application No. 2000-039843 filed on Feb. 17, 2000, and its internal priority claiming application number of which is not yet known, the entire contents of which are herein incorporated by reference.

BACKGROUND OF THE INVENTION

1. Field of the Invention

The present invention generally relates to an image forming apparatus, such as a printer, a copier, a facsimile, etc., and in particular relates to a toner replenishing device capable of replenishing a developing device with toner stored in a toner storage container.

2. Discussion of the Background

In known image forming apparatuses, such as printers, copiers, facsimiles, etc., a toner storage container such as a toner bottle or a toner cartridge is disposed within or in the vicinity of a unit which mounts a developing device. The developing device generally is replenished directly or via a toner hopper with toner conveyed from the toner storage container. In such a construction, conveyance of the toner from the toner storage container to the developing device generally is performed by a mechanical auger such as a screw, a paddle, etc.

However, when the mechanical auger conveys the toner, since the screw, for example, can only be arranged substantially straight, the toner storage container and the toner replenishing device are necessarily integrated with, or in the vicinity of, the developing device. Thus, the construction of the toner replenishing device is complex, costly and has low productivity and a low machine maintenance performance. In addition, protection and maintenance of toner quality characteristics are burdensome. In addition, it is generally difficult for a user to exchange a toner storage container.

Japanese Patent Application Laid Open No. 04-9082A has proposed a toner replenishing device capable of suppressing such problems. Specifically, the toner replenishing device conveys toner using suction generated by a suction device, and has an advantages that toner can be replenished, whatever positional relationship exists between a toner storage container and a developing device or the like.

However, toner utilized in an image forming apparatus which employs an electrophotographic system generally has greatly poor fluidity, and it is typically noted that conveyance of such toner is difficult. Accordingly, there are problems in the above noted toner replenishing device that toner clogging easily arises at a leading end or a middle portion of a suction pipe, and as a result, toner is not smoothly replenished.

SUMMARY OF THE INVENTION

Accordingly, it is an object of the present invention to address the above and other problems and provide a new image processing apparatus. The above and other objects are achieved according to the present invention by providing a novel toner replenishing device including a toner conveyance path extending from a toner storing device to a developing device, a toner conveying device for conveying toner from the toner storing device to the developing device along the toner conveyance path, and an air supplying device connected to the toner conveyance path via an air supply path for supplying the toner storing device with air from a bottom of the toner storing device so as to agitate the toner pooling in the toner storing device.

In yet another embodiment, the toner storing device includes an evacuation section at a top thereof so as to evacuate and receive air.

In yet another embodiment, the evacuation section is made of a breathable filter so as to efficiently evacuate the air.

In yet another embodiment, a multicolor image forming apparatus includes an air supply control device for controlling supplying of air to a plurality of toner storing devices and a fewer number of air generation sources than the plurality of toner storing devices so as to efficiently supply the air to the plurality of toner storing devices.

In yet another embodiment, the air supply control device controls both the driving of the air generation source and the opening and closing of a plurality of openable valves provided in a plurality of toner conveyance paths in such a manner that the plurality of toner storing devices is supplied with air one after another when the air generation sources are driven, so that an amount of air supplied to each of the toner storing devices can independently be supervised.

In yet another embodiment, the toner conveyance path is configured to receive at its middle portion user toner collected by a cleaning device so as to recycle the toner and protect the used toner from needless stress.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
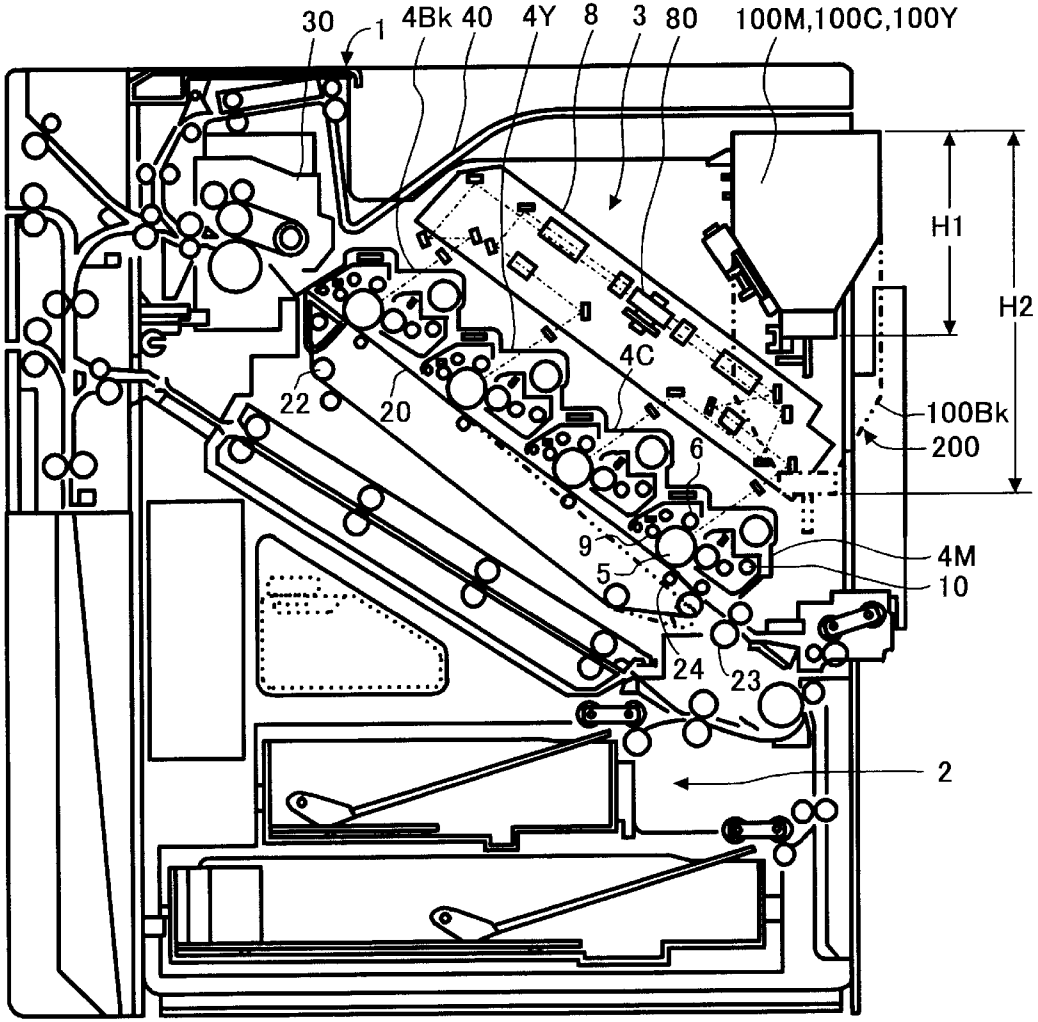
FIG. 1 is a schematic diagram illustrating a color laser printer as one example of an image forming apparatus which is equipped with a toner replenishing device according to the present invention.

Referring now to the drawings, wherein like reference numerals designate identical or corresponding parts throughout several views. FIG. 1 is a schematic diagram illustrating a color laser printer as one example of an image forming apparatus which is equipped with a toner replenishing device according to the present invention. The color laser printer may be configured to include a sheet feeding section 2 arranged at a bottom of its apparatus body, and an image forming section 3 arranged above the sheet feeding section 2. A transfer belt unit may be provided in the image forming section 3, inclined such that a sheet feeding section side is below an ejection side. The transfer belt unit may include an endless transfer belt 20 wound around a plurality of (e.g. four) belt pulleys 22. Four image forming units 4M, 4C, 4Y, and 4Bk, for magenta, cyan, yellow and black images, respectively, may be disposed on an upper running side 21 of the transfer belt 20, and may be arranged in parallel in this order, starting from the lowermost end.

Figure 2:
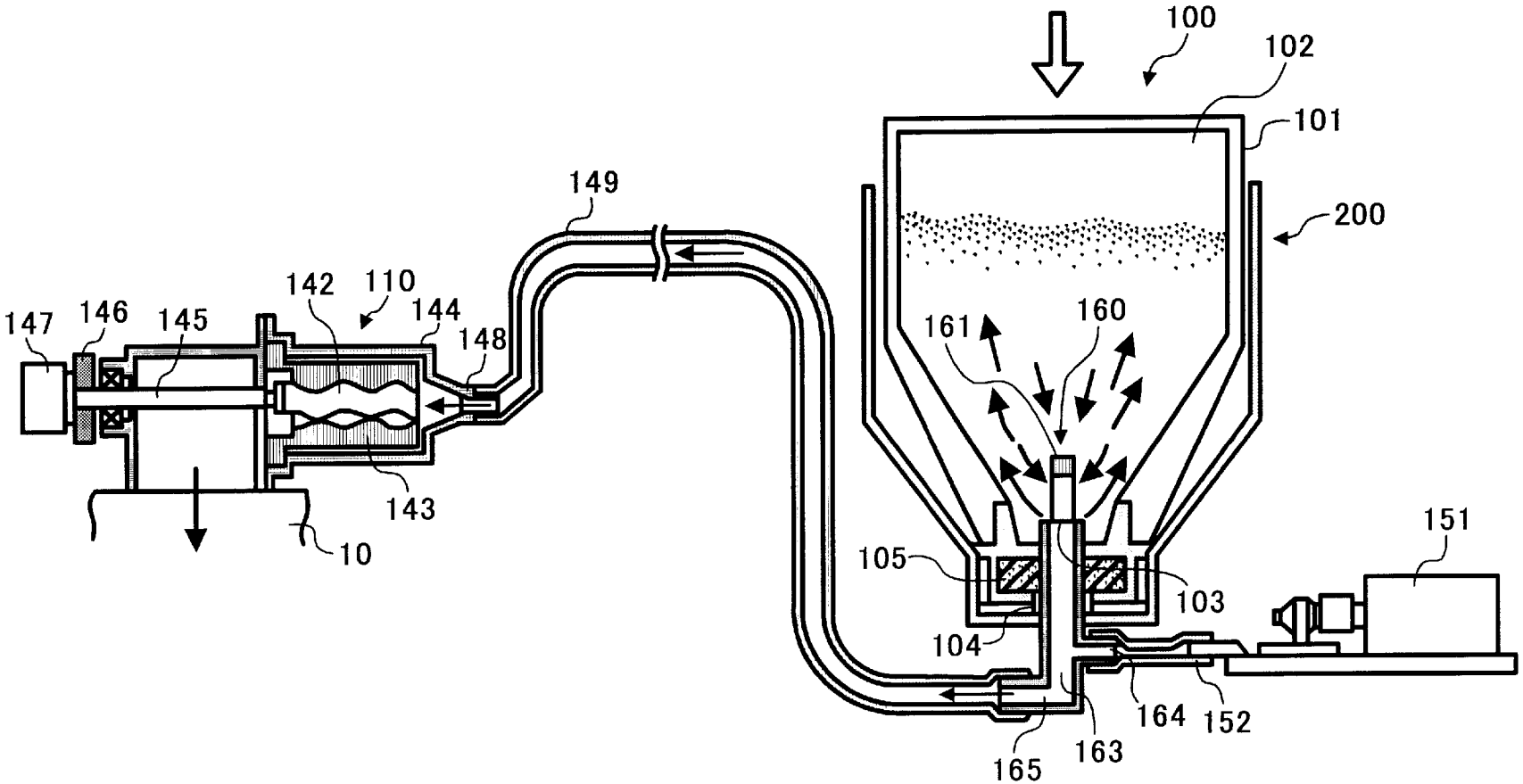
FIG. 2 is a diagram illustrating a toner replenishing device according to the present invention.

As noted from FIGS. 1 and 2, each of the image forming units 4M, 4C, 4Y, and 4Bk may include a phtoconductive drum (PC drum) 5 as an image carrier. The PC drum 5 may be rotated clockwise by a driving device (not shown). Around the PC drum 5 there may be provided a charge roll 6 as a charging device, an optical write section including an optical write device 8 for writing with a laser beam, a developing device 10, and a cleaning device 9. The developing device 10 may be a two component type wherein toner and carrier are employed. The developing device 10 may be replenished with toner by a later described replenishing device corresponding to a toner consumption amount.

A full color image forming process executed by the color laser printer illustrated in FIG. 1 is now described with reference to a typical image forming unit 4M. To write an image to be developed with magenta toner on the PC drum 5, which is charged by the charge roll 6, the optical writing device 8 may drive an LD (laser diode), which generates a laser beam toward a polygon mirror 80, and leads a light reflected by the polygon mirror 80 to the PC drum 5 via a cylinder lens or the like. A latent image may be formed on the PC drum 5 during the writing operation based on image data transmitted from a host machine such as personal computer, and may be visualized with the magenta toner by the developing device 10.

A sheet designated as a transfer member may be fed from the sheet feeding section 2, and may strike against, and temporarily stop at, a register roller 23 provided upstream of the transfer belt 20. The sheet may then fed onto the transfer belt 20 in synchronism with the visualized image, and may arrive at a transfer position opposing the PC drum 5 as transferred by the transfer belt 20. The image having the magenta toner may be transferred onto the sheet at the transfer position by operation of the transfer roller 24 engaged with the backside of the transfer belt 20.

Other mono color toners may also visualize a plurality of remaining mono color images, respectively, on the surface of respective ones of the PC drums 5 of the respective image formation units 4C, 4Y, and 4Bk. Each of these visualized images may be transferred and superimposed every time the sheet arrives at each of the transfer positions. Thus, the color laser printer can quickly transfer and superimpose a fill color image as a monochrome image. The sheet may then be separated from the transfer belt 20 and fixed by the fixing device 30. The sheet may be ejected outside the color laser printer after completing the fixing. Otherwise, the sheet may be inverted and ejected onto an ejection tray 40 which is constituted by an upper surface of the apparatus body 1 with its backside facing upward. Such backside ejection may be an essential condition for a printer when arranging the sheets in order of pages.

A toner replenishing device for replenishing each of image formation units 4M,4C, 4Y, and 4Bk with applicable toner contained in each of toner storage containers 100M, 100C, 100Y, and 100Bk is now described with reference to FIG. 2. A construction of each toner replenishing device may substantially be the same.

A uniaxial eccentric screw pump as a powder pump 110 of a suction type may be provided in a body or in the vicinity of the developing device 10. The powder pump 110 may be constructed with a rotor 142 which is made of rigid material such as metal and is formed in an eccentric screw shape, a stator 143 which is made of elastic material such as rubber and is formed in a two rowed screw shape, and a holder 144 which is made of plastic and encloses these devices, thereby forming a conveyance path for powder. The rotor 142 may be driven via a gear 146 connected in a body to a driving shaft 145 via a pin joint. An electromagnet clutch 147 controls an operation of the powder pump 110.

At the leading end of the holder 144 (i.e., at a right end in FIG. 2), there may be provided a toner suction section 148. The toner suction section 148 may be connected to a toner use connection opening 165 disposed at one end of a nozzle 160 (described later in detail) via a toner conveyance tube 149. The toner conveyance tube 149 may be flexible and have a diameter of from 4 to 10 mm, and may be made of rubber such as polyurethane, nitrile, EPDM, silicon, etc., having superior resistance to degradation by toner, so that the tube can be easily arranged in an optional direction such as upward, downward, rightward, leftward, etc. It is noted that the powder pump 110 can continuously convey a prescribed amount of toner at a high substance/air ratio, and the toner conveyance amount accordingly can be precisely in proportion to the number of rotations of the rotor 142. To this end, when a toner replenishment instruction is generated after image density detection or the like, the powder pump 110 may operate so as to replenish the developing device 10 with a requested mount of toner.

A set portion 200 (see FIG. 2) may be provided in the image forming apparatus body 100 as to accept the toner storage container 100. The set portion 200 may separately be constructed from the developing device 10. A stationary nozzle 160 maybe installed in the set portion 200 in a standing condition to be inserted into a toner bag 102 and have a circular cross section. The toner storage container 100 may be set onto the set portion 200 from above. The nozzle 160 may have a single tube construction and include, at its upper section, a tapered member 161 which has a cone shape section and is integrally molded or fixed thereto. Downwardly extending from the tapered member 161, there may be provided a passage 163 which serves both as air supply and toner replenishment routes. The nozzle 160 may have, at its interior, a single tube construction. The passage 163 may be bent leftward, when viewing the drawing, at the lowermost end of the nozzle 160. At a leftmost leading end of the passage 163, there may be provided a toner use connection opening 165 which is inserted into the toner conveyance tube 149. The passage 163 may also be bent rightward when viewing the drawing at a position above the toner use connection opening 165 and provided with an air connection opening 164.

The air connection opening 164 may be connected to an air pump 151 as an air supply source via an air transfer pipe 152. When the air pump 151 operates, some of air may gush out into the toner storage container 100 from the lower side thereof via the air transfer pipe 152 and the air supply route. This air may then agitate and thereby fluidize the toner while passing through a toner pool.

The toner storage container 100 may be a bag in a box type and is constructed by an external box 101 as a protection case, and a toner bag 102 of a bag shape, which is detachably installed and has flexibility so as to be deformed. The external box 101 may be made of rigid material such as paper, corrugated paper, plastic, etc., and has a prescribed internal dimension that is capable of accepting the toner bag 102 substantially without creating a gap therebetween. Thus, the toner storage container 100 may have advantages of easy handling and sorting during storage, in addition to protection of the flexible toner bag 102.

Further, a bag portion of the toner bag 102 may be constructed by a single layer or a plurality of layers of a flexible sheet like material having thickness of from 80 to 125 m. The flexible material may be made of polyester, polyethylene, etc. A mouthpiece member 103 made of plastic such as polyethylene, nylon, etc., may be secured to the toner bag 102 and include, at substantially the center of the bottom section, a toner ejection hole 104. In the mouthpiece member 103, there may be provided a seal member 105 which is constituted by a single or a plurality of layers and made of stiff elastic material such as expanded sponge, etc. The seal member 105 may function as a shut-in valve. The toner bag 102 may have an a tapered shape narrowing to the toner ejection hole 104 so that toner hardly remains therein. Accordingly, a nozzle 160 may be inserted into the toner storage container 100 in the vertical direction from the lower side thereof (i.e., right down side) when the toner storage container 100 is set onto the set portion 200.

With the above described image forming apparatus, when toner is suctioned by the powder pump 110 and if an angle of a slope of the toner bag towards its bottom is small, since the toner hardly drops in the vicinity of the nozzle 160 by gravity, the toner remains in the bag. Since the remaining toner may become readily suctioned if sufficiently agitated and fluidized while the toner storage container 100 is supplied with extensive air, an amount of the remaining toner can be greatly minimized (in such situation). However, since an amount of air supplied to the toner storage container 100 is limited to a capacity of the toner storage container 100, the toner may probably be insufficiently agitated, due to insufficient supply of air.

Figure 3B:
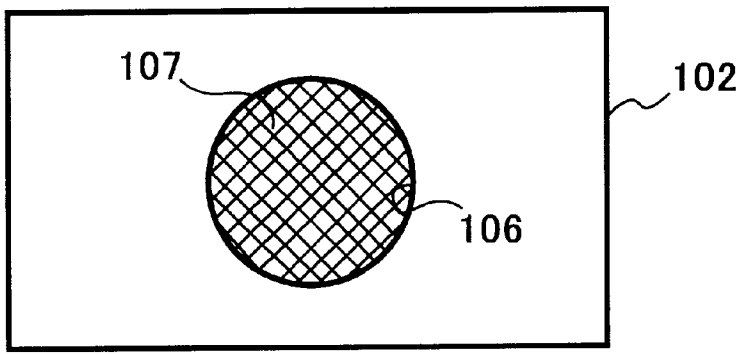
FIGS. 3A and 3B are front and plan views illustrating the toner replenishing device illustrated in FIG. 2.
Figure 3A:
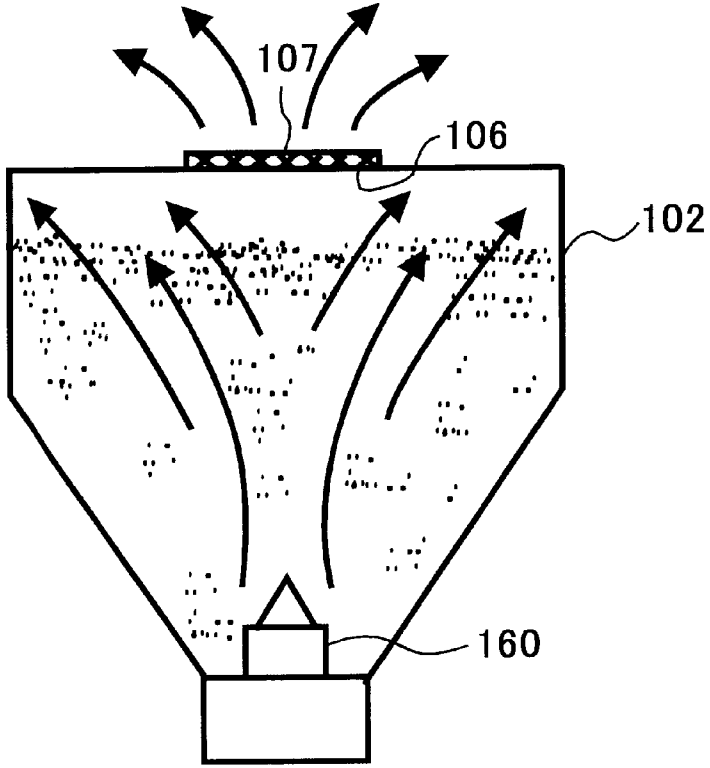

In such a situation, so as to decrease interior pressure, the toner storage container 100 may be provided with an opening 106 as an evacuation section, as illustrated in FIGS. 3*a* and 3B. In addition, a breathable filter 107 capable of allowing air passage and inhibiting passage of toner may be provided to cover the opening 106. The breathable filter 107 may be disposed on the upper wall of the toner storage container 100 opposite to the seal member 105 which allows insertion of the nozzle 160, so that air which has sufficiently agitated the toner can be evacuated therefrom.

If constructed in the above-described manner, since air supplied to the toner storage container 100 can partially be evacuated outside thereof through the breathable filter 107, the toner storage container 100 can be supplied with air substantially in the limitless manner. Thus, since toner in the toner storage container 100 can be sufficiently agitated by extensively supplied air, the toner can smoothly be suctioned by the powder pump 110, and an amount of remaining toner in the toner storage container 100 can be greatly decreased.

As described above, if a toner storage container 100 is provided with a breathable filter 107, the storage container 100 can be supplied with extensive air. Since extensive air is supplied by the air pump 151 and the full color image forming apparatus includes four toner storage containers 100M, 100C, 100Y, and 100Bk, four units of an air supplying device are necessarily required. However, it is typically costly and needs a large setting space to provide a plurality of air pumps 151.

Figure 4:
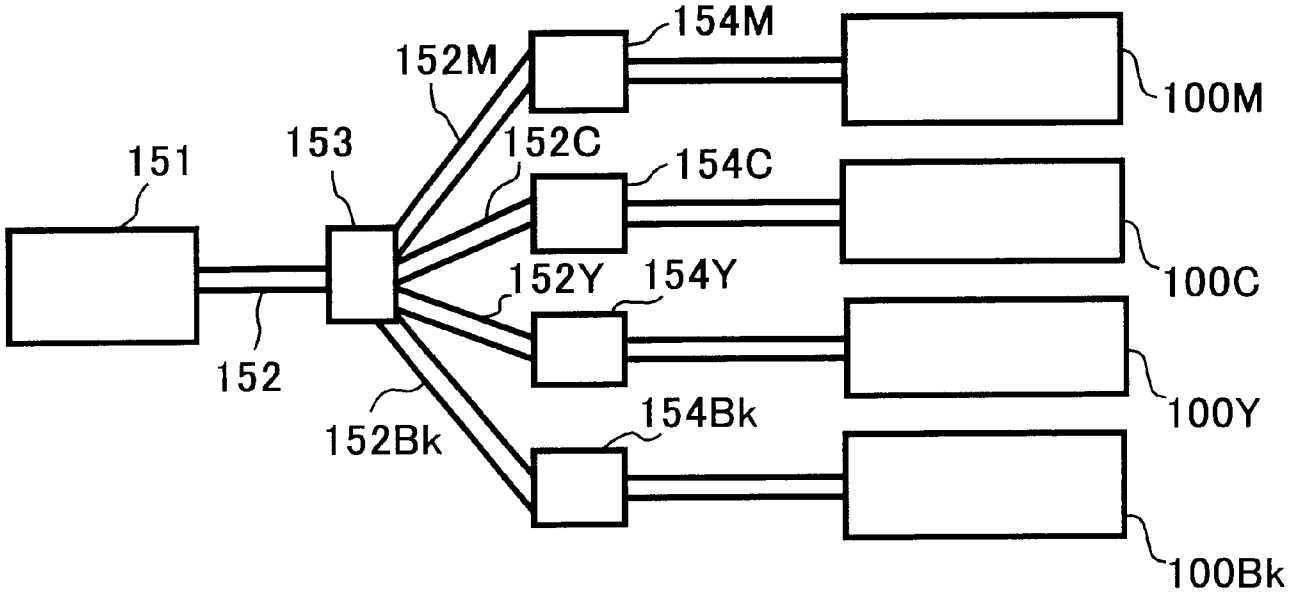
FIG. 4 is a schematic diagram illustrating one embodiment of the toner replenishing device according to the present invention.

To this end, the present invention may be constructed in a manner as illustrated in FIG. 4. As noted from FIG. 4, a plurality of toners having different colors, such as yellow, magenta, cyan, and black may be stored in toner storage containers 100Y, 100M, 100C, and 100Bk, respectively. These toner storage containers 100Y, 100M, 100C, and 100Bk may be provided with air by a prescribed number of air pumps 151 which number is less than that of the toner storage containers 100 (e.g., one in this embodiment). Specifically, a tetra pod section 153 may be provided in an air transfer pipe 152 that is connected to the air pump 151 so as to separate an air supply passage into four parts (i.e., four pipes 152M, 152C, 152Y, 152Bk). These four pipes may be connected to four nozzles 160M, 160C, 160Y, and 160Bk, respectively, which are inserted into the toner storage containers 100M, 100C, 100Y, and 100Bk, respectively. Four openable valves 154M, 154C, 154Y and 154Bk may be provided in the four air transfer pipes 152M, 152C, 152Y, 152Dk, respectively, so as to control air supply. An operation of the air pump 151, and opening and closing operations of the respective four openable valves 154M, 154C, 154Y, and 154Bk, may be controlled by a prescribed control section (not shown).

With a color image forming apparatus constituted in the above-described manner, since one or more air pumps 151 having a fewer number than the toner storage containers 100 are employed, the color image forming apparatus can be compact and its cost can be lowered.

Figure 5:
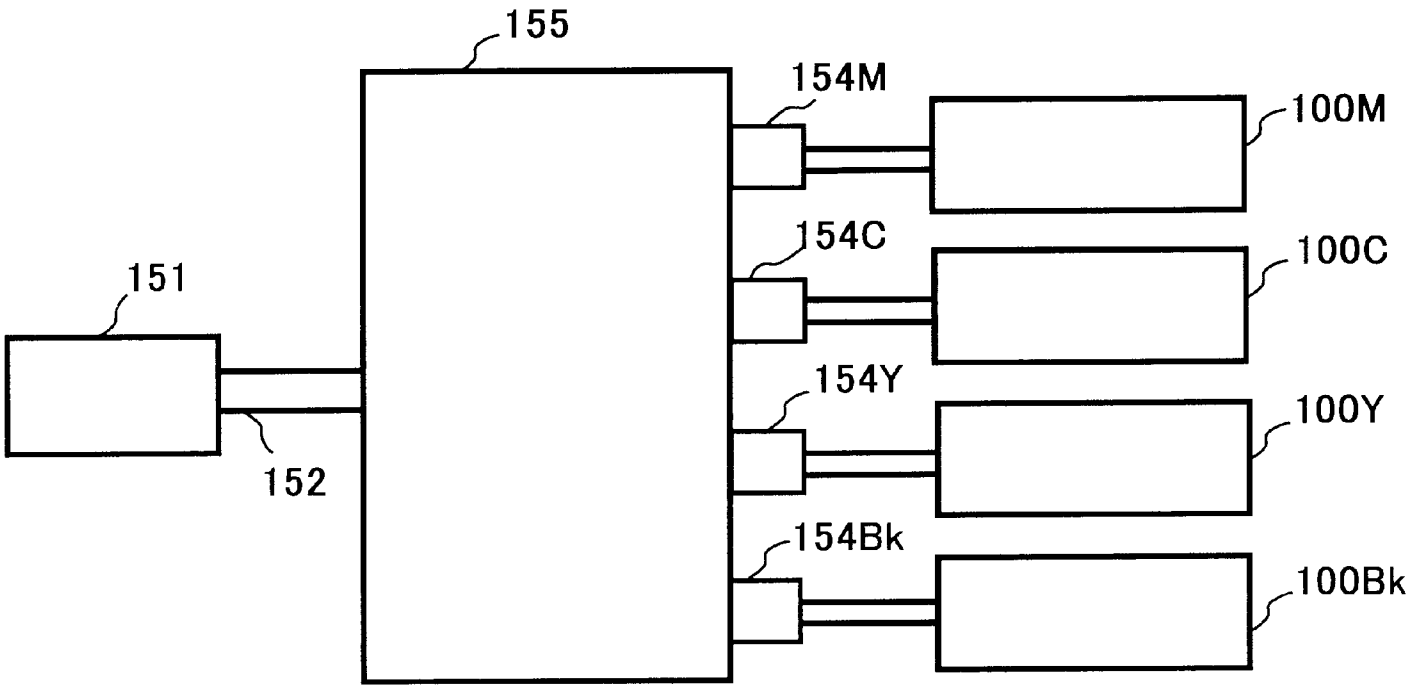
FIG. 5 is a schematic diagram illustrating another embodiment of the toner replenishing device according to the present invention.

The second embodiment will be now described with reference to FIG. 5. A surge tank 155 capable of storing air may be provided between the air pump 151 and each of the toner storage containers 100M, 100C, 100Y, and 100Bk as an air storage section. The four air transfer pipes 152M, 152C, 1523Y, 152Bk, connected to respective ones of the nozzles 160M, 160C, 160Y, and 160Bk which are inserted into the toner storage containers 100M, 100C, 100Y, and 100Bk, respectively, may be included in the surge tank 155. In addition, a plurality of openable valves 154M, 154C, 154Y, and 154Bk may be provided either at a plurality of outlets of the surge tank 155 or a plurality of appropriate sections of the four air transfer pipes 152M, 152C, 1523Y, 152Bk, respectively.

With such a construction, the color image forming apparatus can be compact and a cost thereof can be lowered as in the earlier described embodiment. In the first and second embodiments of FIGS. 4 and 5, when the plurality of openable valves 154M, 154C, 154Y, and 154Bk is open so as to simultaneously supply air to the plurality of toner storage containers 100M, 100C, 100Y, and 100Bk, an amount of the air supplied to each of the plurality of toner storage containers 100M, 100C, 100Y, and 100Bk may be different from others. This is, for example, because when two openable valves 154 are turned ON, air generally is excessively supplied to one of toner storage containers because of its weak pressure due to a lesser amount of toner, and as a result, each of the toner storage containers does not receive exactly half of the supplied air. Specifically, an air supplying amount can not be precisely controlled in such a case.

Figure 6:
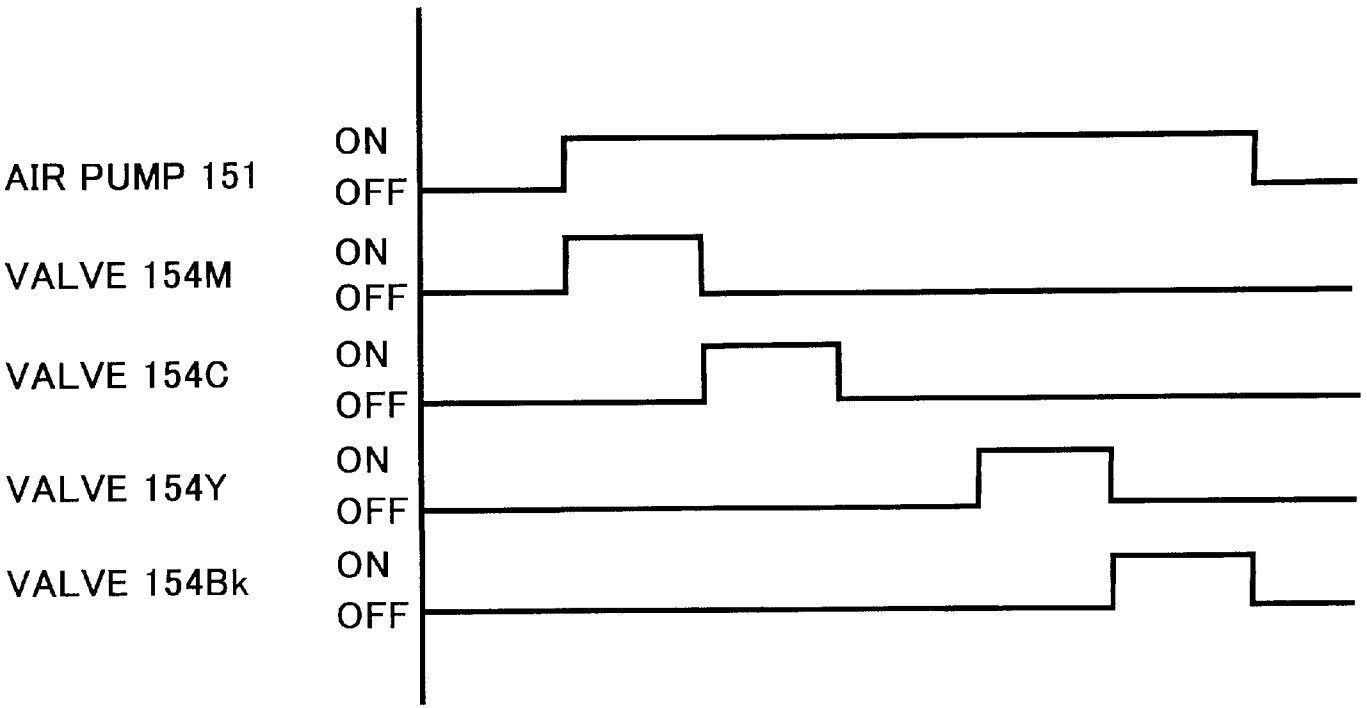
FIG. 6 is a timing chart illustrating exemplary air supply control executed in the embodiment of the toner replenishing device illustrated in FIG. 4.
Figure 7:
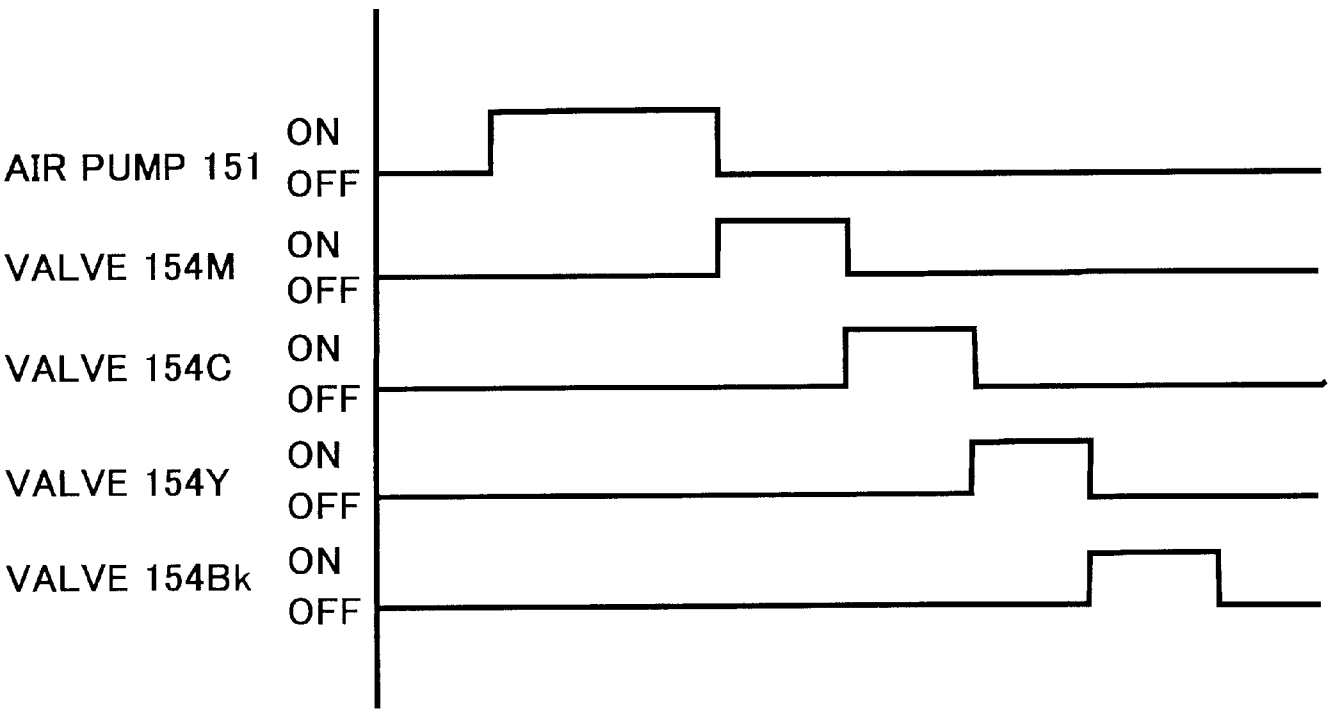
FIG. 7 is a timing chart illustrating exemplary air supply control executed in the embodiment of the toner replenishing device illustrated in FIG. 5.

Then, the plurality of openable valves 154M, 154C, 154Y, and 154Bk illustrated in FIG. 4 may synchronously be turned ON with activation of the air pump 151, but controlled not to simultaneously be turned ON, as illustrated in FIG. 6. Further, as illustrated in FIG. 7, the plurality of openable valves 154M, 154C, 154Y, and 154Bk of FIG. 5 may be controlled not to simultaneously be turned ON, even when these openable valves need not be synchronously turned ON with the air pump 151 because of the surge tank 155.

Thus, if the plurality of openable valves is controlled in the above-described manner, an amount of air supplied to each of the toner storage containers 100M, 100, 100Y, and 100Bk can readily be recognized from the capacity of the air pump 151 and its operation time period. As a result, the amount of air can easily be supervised.

Figure 8:
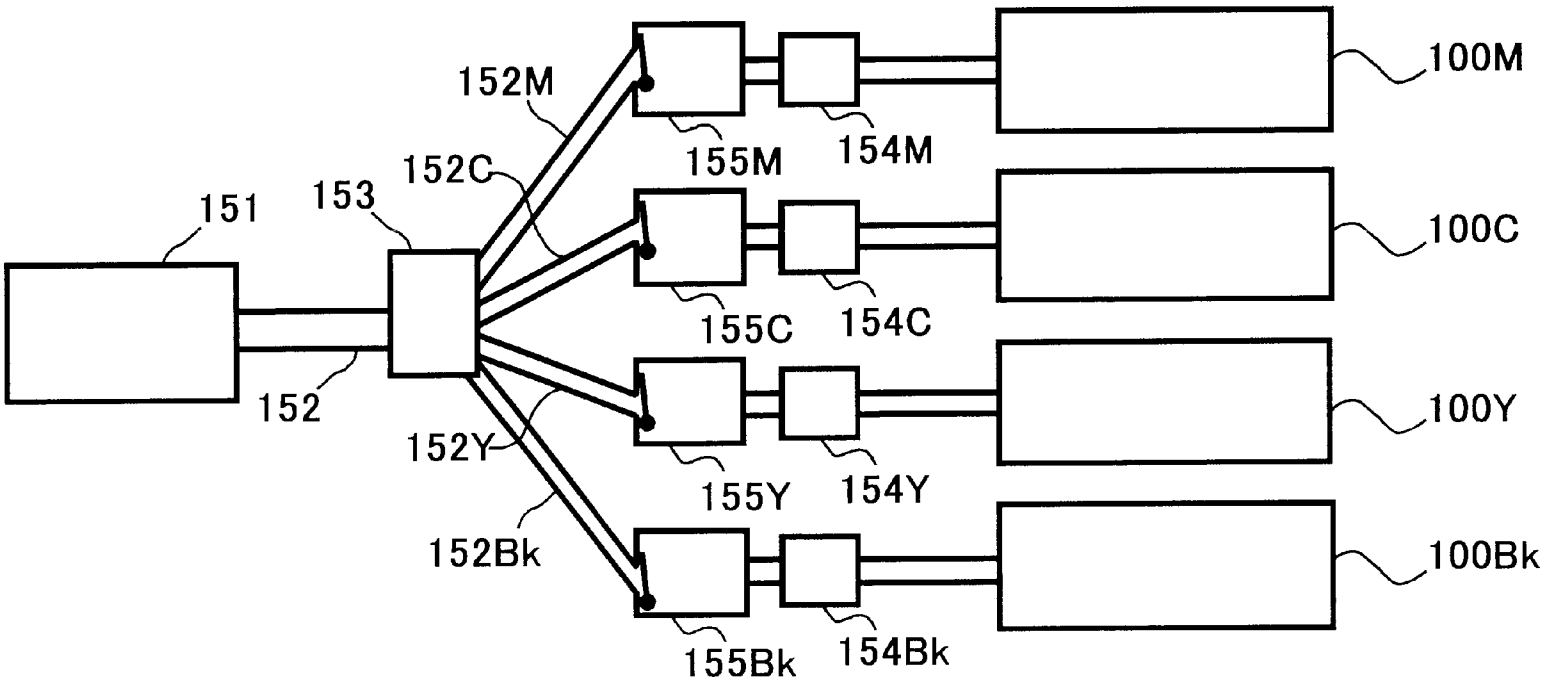
FIG. 8 is a schematic diagram illustrating a modification of the toner replenishing device according to the present invention.

FIG. 8 is a schematic diagram for illustrating another modification of the above-described embodiments. A tetra pod 153 may be provided in an air transfer pipe 152, which is connected to an air pump 151, so as to divide an air supply passage into four parts (i.e., air transfer pipes 152M, 152C, 2152Y, and 152Bk). These four air transfer pipes 152M, 152C, 152Y, and 152Bk may be connected to nozzles 160M, 160C, 160Y, and 160Bk, respectively, which are installed in the toner storage containers 100M, 100C, 100Y, and 100Bk, respectively. The four air transfer pipes 152M, 152C, 152Y, and 152Bk may be provided with valve-cum-surge tanks 155M, 155C, 155Y, and 155Bk, respectively, as an air storage section, and a plurality of openable valves 154M, 154C, 154Y and 154Bk, respectively, as an air supply controller.

Due to such a construction, the image forming apparatus can be compact and its cost can be lowered as in the above-described embodiments. In addition, since the valve-cum-surge tanks 155M, 155C, 155Y and 155Bk are provided to the air transfer pipes 152M, 152C, 152Y, and 152Bk, air can simultaneously be supplied to a plurality of toner storage containers 100. In addition, since the powder pump 110 ejects toner in the toner storage container 100 after air is supplied, it rarely remains therein. As a result, the image forming apparatus can be economical, and a used toner storage container 100 can safely and sanitarily be discarded or recycled.

Figure 9:
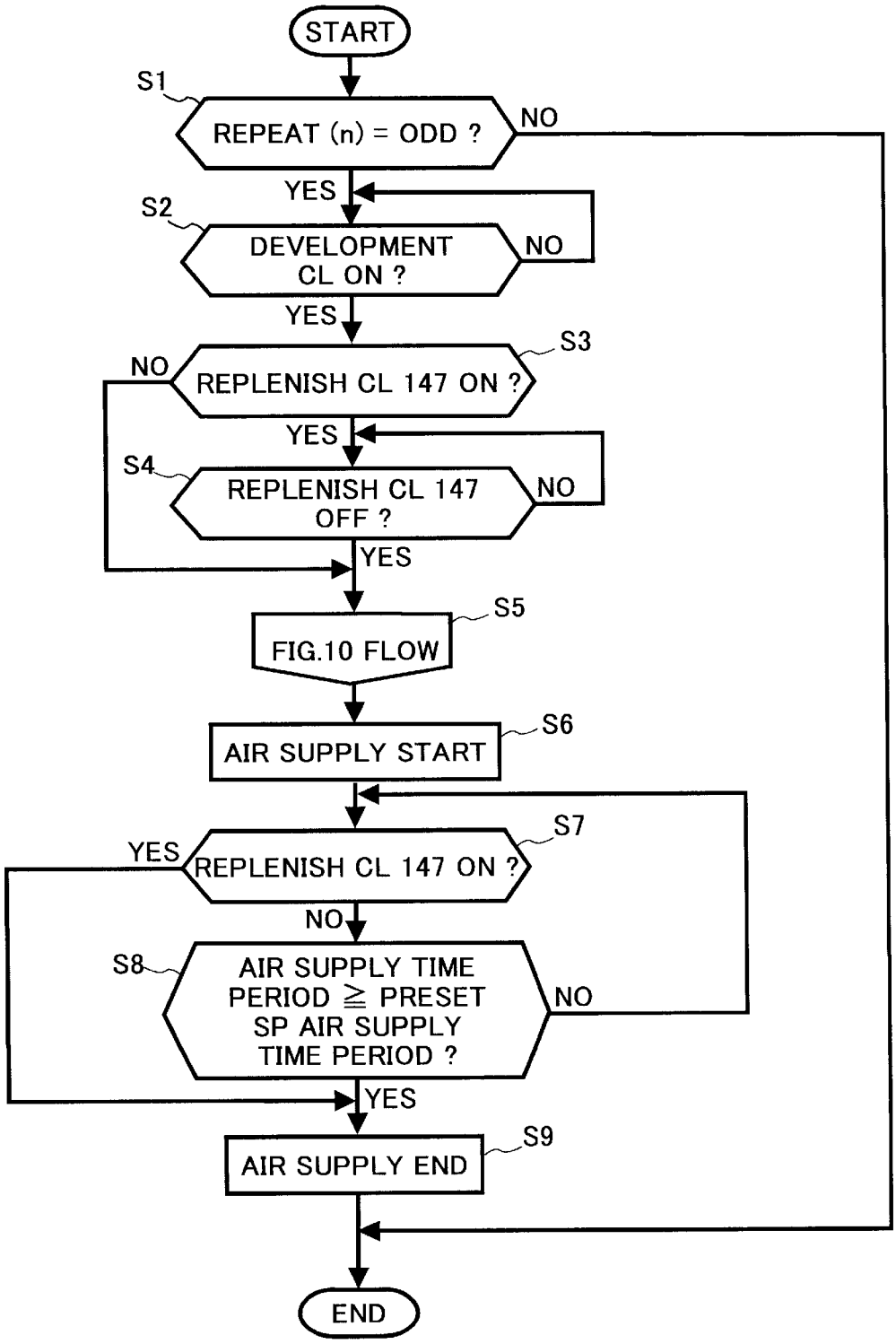
FIG. 9 is a flowchart illustrating air supply control executed in every mono color developing processes of the color laser printer illustrated in FIG. 1.
Figure 10:
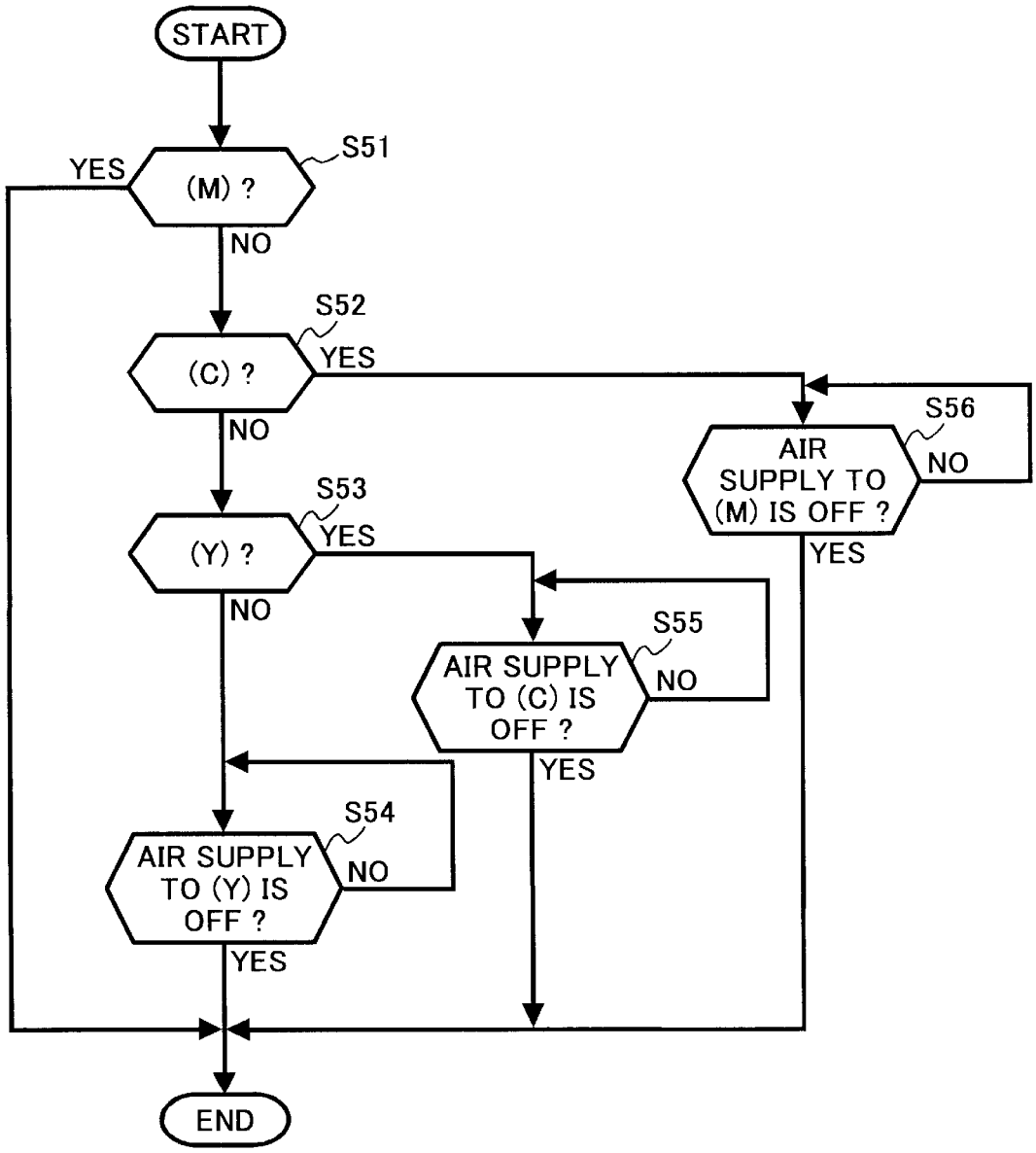
FIG. 10 is a flowchart illustrating in detail one example of an air supply step in the flowchart illustrated in FIG. 9.

Control of air supply to each of the toner storage containers 100M, 100C, 100Y, and 100Bk performed in the color laser printer illustrated in FIG. 1 will now be described with reference to FIGS. 9 and 10.

A toner replenishing process will be now described with reference to FIGS. 9 and 10. When a plurality of mono color developing units in the developing device 10 develops an latent image and is replenished with applicable color toner from applicable toner storage containers 100M, 100C, 100Y, and 100Bk, air supply to applicable toner containers may be controlled in a manner as illustrated in FIGS. 9 and 10. Specifically, the flow may be repeated whenever the mono color developing units start developing the latent image.

Considering air supply efficiency or the like, air may be supplied when image formation is repeated for an odd number. To this end, it may initially be determined if current image formation repetition is related to an odd number (in step S1). Subsequently, when image formation repetition is related to the odd number, it is determined if a development clutch (not shown) is turned ON (in step S2). When the development clutch is turned ON (Yes, in step S2), it is determined if a clutch 147 of the powder pump 110 is turned ON (in step S3). When the clutch 147 is turned ON (Yes, in step S3), a developing device may be supplied with toner. It is then determined whether the clutch 147 is turned OFF (in step S4). When the clutch 147 is deactivated, and as a result toner supply is stopped, the air may be supplied (in step S6). In this instance, since the air is independently supplied to respective ones of toner storage containers 100M, 100C, 100Y and 100Bk as illustrated in FIG. 10, any one of the toner storage containers 100M, 100C, 100Y, and 100Bk may be selected, one by one, to be supplied with the air (in steps S51 through S56).

Specifically, when a latent image is developed by the magenta developing unit (Yes in step S51), which initially develops the latent image, air supply for the magenta toner container may start (in step S6). If the image is subsequently developed by the cyan developing unit (No, in step S51, Yes, in step S52), and the air supply to the magenta toner container is turned OFF (Yes, in step S56) as illustrated in FIGS. 6 and 7, air supply for the cyan toner container may start (in step S6). If the image is subsequently developed by the yellow developing unit (No, in step S52, Yes, in step S53), and the air supply to the cyan toner container is turned OFF (Yes, in step S55) as illustrated in FIGS. 6 and 7, air supply for the yellow toner container may start (in step S6). If the image is developed by the black developing unit (No, in step S53), and the air supply to the yellow toner container is turned OFF (Yes, in step S54) as illustrated in FIGS. 6 and 7, air supply for the black toner container may start (in step S6).

Whenever the air supply has not yet been completed in the previous color developing process, the present air supply may wait for termination thereof (No, in steps S54, S55, and S56). The air supply may be stopped when the clutch 147 is turned ON (Yes, in step S7), or a prescribed preset air supply tome period has elapsed after air supply start (Yes, in step S8).

The third embodiment will now be described with reference to FIGS. 11 and 12. In the image forming apparatus, toner remaining on a transfer member such as an image carrier, a transfer belt, etc., is typically collected by a cleaning device, and the collected toner is generally reusable. To reuse the collected toner, since the cleaning device is generally disposed far from a developing device due to different functions, it should generally be conveyed.

Figure 12:
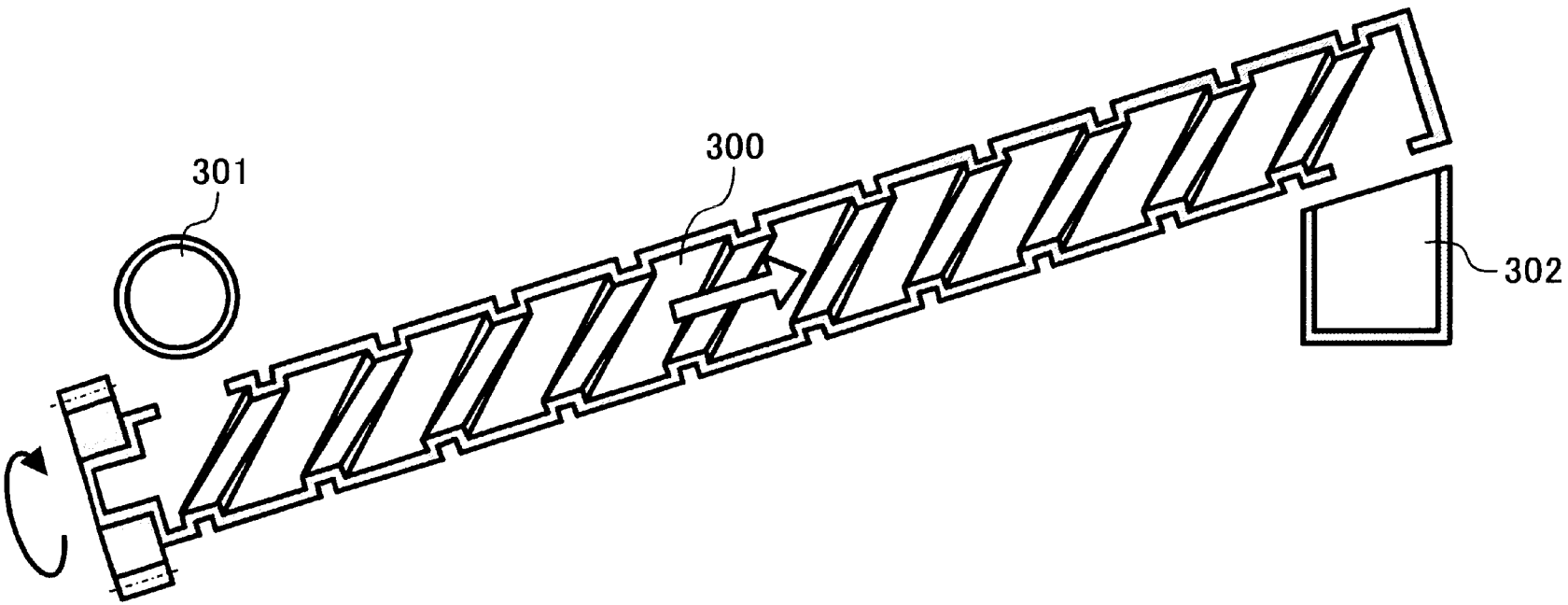
FIG. 12 is a schematic diagram illustrating one example of a conventional toner conveying device.

FIG. 12 illustrates on example of a conventional collected toner conveyance device. As noted therefrom, toner collected by a cleaning device is ejected from an ejection outlet 301 and received by a spiral shaped pipe 300 at its one end. The collected toner is conveyed when the spiral shaped pipe 300 is rotated in a prescribed direction to an inlet 302 of a developing device, which inlet is provided beside the other end of the spiral shaped pipe 300. However, such a collected toner conveyance generally imposes abnormal stress on the collected toner, resulting in toner blocking (i.e., coagulation due to melting adhesion, etc.), crushing, etc. Thus, toner characteristics vary and toner conveyance may sometimes be impossible. In addition, the spiral shaped pipe 300 and its drive member may occasionally be damaged. In addition, since toner characteristics vary due to the stress, there is a problem wherein a color image forming apparatus typically produces a low quality color image having a plurality of spots.

Figure 11:
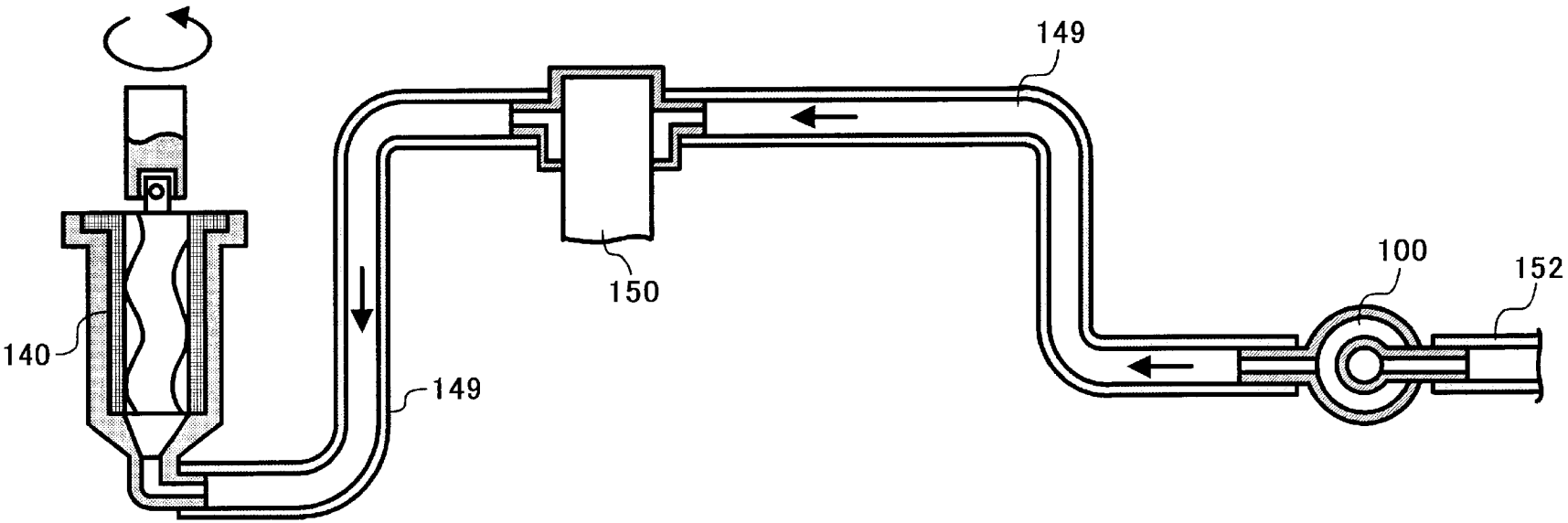
FIG. 11 is a schematic diagram illustrating another embodiment of the toner replenishing device according to the present invention.

According to the third embodiment of the present invention of FIG. 11, a toner conveyance tube 149, which connects a toner storage container 100 with a powder pump 140 provided in the vicinity of the developing device 10, may be arranged via a collected toner ejection outlet 150 which is disposed in the vicinity of the cleaning device (not shown). Since the toner conveyance tube 149 is flexible, the conveyance tube 149 can readily be arranged via the collected toner ejection outlet 150.

Thus, since fresh toner stored in the toner storage container 100 is conveyed to the developing device 10 via the collected toner ejection outlet 150, the fresh toner can be mixed with the collected toner from the middle of a toner conveyance process. In addition, since toner conveyance by the powder pump 140 substantially does not impose needless stress, and new toner is conveyed while being mixed with air along the toner conveyance members, mechanical stresses substantially are not imposed on collected toner mixed with the fresh toner.

Thus, if collected toner is reused, since a toner conveyance process substantially does not impose needless stress on the collected toner, an image formed by using such collected toner can substantially surely prevent generation of spots or the like in an image.

The mechanisms and processes set forth in the present invention may be implemented using one or more conventional general purpose microprocessors and/or signal processors programmed according to the teachings in the present specification as will be appreciated by those skilled in the relevant arts. Appropriate software coding can readily be prepared by skilled programmers based on the teachings of the present disclosure, as will also be apparent to those skilled in the relevant arts. However, as will be readily apparent to those skilled in the art, the present invention also may be implemented by the preparation of application-specific integrated circuits by interconnecting an appropriate network of conventional component circuits or by a combination thereof with one or more conventional general purpose microprocessors and/or signal processors programmed accordingly. The present invention thus also includes a computer-based product which may tee hosted on a storage medium and include, but is not limited to, any type of disk including floppy disks, optical disks, CD-ROMs, magnet-optical disks, ROMs, RAMs, EPROMS, EEPROMs, flash memory, magnetic or optical cards, or any type of media suitable for storing electronic instructions.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letter Patent of the United States is:

1. A multicolor image forming apparatus employing an electrophotographic system, comprising:

a plurality of developing devices configured to develop a latent image with different mono color toners;

a plurality of toner storing devices configured to store the different mono color toners, respectively; and a toner replenishing device configured to replenish the plurality of developing devices with applicable mono color toner; wherein said toner replenishing device includes a plurality of toner conveyance paths extending from the plurality of toner storing devices to the plurality of developing devices, respectively, a toner conveying device configured to convey the different mono color toners from the plurality of toner storage containers to the plurality of developing devices, respectively, along an applicable toner conveyance path, and an air supplying device configured to supply the plurality of toner storing devices with air from bottoms of the plurality of toner storing devices; wherein said air supplying device is connected to the plurality of toner conveyance paths via a plurality of air supply paths and includes an air supply control device configured to control supplying of air to the plurality of toner storing devices and a smaller number of air generation sources than said plurality of toner storing devices.

2. The multicolor image forming apparatus according to claim 1, wherein said plurality of air supply paths include a plurality of openable valves.

3. The multicolor image forming apparatus according to claim 2, wherein said air supply control device controls both a driving of the air generation source and opening and closing of the plurality of openable valves in such a manner that the plurality of toner storing devices are sequentially supplied with the air when the air generation sources are driven.

4. The multicolor image forming apparatus according to claim 3, wherein said air generation source includes an air storing device supplied with air by an air pump.

5. The multicolor image forming apparatus according to claim 4, wherein said air supply control device controls driving of the air pump and opening and closing of the plurality of openable valves in such a manner that the plurality of toner storing devices is sequentially supplied with air when the air pump is driven and the air storage device is filled with the air.

6. An image forming apparatus employing an electrophotographic system, comprising:

a toner storing device configured to store toner;

a developing device configured to develop a latent image with toner;

a cleaning device configured to collect toner used by the developing device, the toner cleaning device including a toner ejection hole configured to eject the toner collected by the cleaning device; and a toner replenishing device configured to replenish the developing device with the toner, the toner replenishing device including a toner conveyance path extending from the toner storing device to the developing device, wherein said toner ejection hole is connected to a middle portion of the toner conveyance path via a used toner conveyance path.

7. The image forming apparatus according to claim 6, wherein said toner replenishing device includes a powder pump configured to suck both the toner of the toner storing device and the used toner ejected from the toner collecting device.

8. The image forming apparatus according to claim 7, wherein both of said toner conveyance path and used toner conveyance path are comprised of a pipe made of flexible material.

9. A multicolor image forming apparatus employing an electrophotographic system, comprising:

developing means for developing a latent image with different mono color toners;

toner storing means for storing the different mono color toners, respectively; and toner replenishing means for replenishing the developing means with applicable mono color toner; wherein said toner replenishing means include the toner conveyance allowing means extending from the toner storing means to the developing means, respectively, toner conveying means for conveying the different mono color toners from the toner storing means to the developing means, respectively, along applicable toner conveyance allowing means, and air supplying means for supplying the toner storing means with air from bottoms of the toner storing means; wherein said air supplying means are connected to the toner conveyance allowing means and include air supply control means for controlling supplying of air to the toner storing means and a smaller number of air generation means for generating air than said toner storing means.

10. The multicolor image forming apparatus according to claim 9, wherein said air supply control means controls both driving of the air generation means and opening and closing of the toner conveyance path means in such a manner that the toner storing means are sequentially supplied with the air when the air generation means are driven.

11. An image forming apparatus employing an electrophotographic system, comprising:

toner storing means for storing toner;

developing means for developing a latent image with toner;

cleaning means for cleaning and collecting toner used by the developing means, the cleaning means including toner ejection means for ejecting toner collected by the cleaning means; and toner replenishing means for replenishing the developing means with the toner, the toner replenishing means including toner conveyance allowing means for allowing conveyance of toner from the toner storing means to the developing means, wherein said toner ejection means are connected to a middle portion of the toner conveyance allowing means.

12. A multicolor image forming method, comprising the steps of:

providing a plurality of toner storing devices configured to store different mono color toners;

providing a plurality of developing devices configured to develop a latent image with toner;

replenishing the plurality of developing devices with applicable mono color toner;

providing a plurality of toner conveyance paths extending from the plurality of toner storing devices to the plurality of developing devices, respectively, conveying the different mono color toners from the plurality of toner storing devices to the plurality of developing devices, respectively, along an applicable toner conveyance path, providing an air supplying device configured to supply the plurality of toner storing devices with air from bottoms of the plurality of toner storing devices;

connecting the air supplying device to the plurality of toner conveyance paths via a plurality of air supply paths;

providing an air supply control device configured to control supplying of air to the plurality of toner storage containers; and providing a smaller number of air generation sources than said plurality of toner storing devices.

13. The multicolor image forming method according to claim 12, further comprising the step of controlling both driving of the air generation source and opening and closing of the plurality of toner conveyance paths in such a manner that the plurality of toner storage containers is sequentially supplied with the air when the air generation sources is driven.

14. An image forming method, comprising the steps of:

providing a toner storing device configured to store toner;

providing a developing device configured to develop a latent image with toner;

providing a cleaning device configured to collect toner used by the developing device;

providing a toner election hole configured to eject the toner collected by the cleaning device;

providing a toner replenishing device configured to replenish the developing device with the toner;

providing a toner conveyance path extending from the toner storing device to the developing device; and connecting said toner ejection hole to a middle portion of the toner conveyance path via a used toner conveyance path.

15. The image forming method according to claim 14, further comprising the step of sucking both the toner from the toner storing device and the used toner ejected from the toner cleaning device.

16. A multi color image forming method, comprising the steps of:

determining if replenishment with toner to a prescribed toner container used in the development is in progress;

determining if the toner replenishment is terminated;

determining if an air supply to another toner container is not executed or terminated when the toner replenishment is terminated;

supplying the prescribed toner container with air when the air supply to the another toner container is not executed or terminated; and stopping supply of the air to the prescribed toner container when a prescribed amount of air has been supplied thereto.

17. The multi color image forming method according to claim 16, further comprising the step of determining if development is in progress, wherein said step of determining if replenishment with toner to a prescribed toner container used in the development is in progress is performed when the development is in progress.

18. The multi color image forming method according to claim 17, further comprising the step of determining if repetition of multi color image formation is related to an odd or even number, wherein said step of determining if development is in progress is performed when the repetition of multi color image formation is related to the odd or even number.

19. The multi color image forming method according to claims 16 and 17, wherein said step of supplying the prescribed toner container with the air includes the step of counting a prescribed time period after the air is supplied thereto.

20. The multi color image forming method according to claims 17 and 18, wherein each of said steps is repeated every time different mono color image formation is performed.

21. The multi color image forming method according to claims 17 and 18, wherein each of said steps is repeated from the first to the last mono color developments subsequently executed in synchronism with passage of an image carrier.

22. A toner replenishing apparatus configured to replenish developing means with toner stored in toner storing means, said toner replenishing apparatus comprising:

toner guiding means for guiding toner from the toner storing means to the developing means;

toner conveying means for conveying the toner from the toner storing means to the developing means along the toner guiding means; and air supplying means for supplying the toner storing means with air from a bottom of the toner storing means, wherein said air supplying means are connected to the toner guiding means and are connected to the toner conveyance means and include air supply control means for controlling supplying of air to the toner storing means and a smaller number of air generation means for generating air than said toner storing means.

23. A multicolor image forming apparatus employing an electro-photographic system, comprising:

a plurality of developing means for developing a latent image with different mono color toners;

a plurality of toner storing means for storing the different mono color toners; and toner replenishing means for replenishing the plurality of developing means with applicable mono color toner; wherein said toner replenishing means include a plurality of toner guiding means for guiding the toner from the plurality of toner storing means to the plurality of developing means, respectively, toner conveying means for conveying the different mono color toners from the plurality of toner storing means to the plurality of developing means, respectively, along the applicable toner guiding means, and air supplying means for supplying the plurality of toner storing means with air from bottoms of the plurality of toner storing means; wherein said air supplying means are connected to the plurality of toner guiding means and includes air supply controlling means for controlling supply of air to the plurality of toner storing means and a smaller number of air generating means for generating air than said plurality of toner storing means.

24. The multicolor image forming apparatus according to claim 23, wherein said air supply controlling means control both driving of the air generating means and opening and closing of the plurality of air guiding means in such a maimer that the plurality of toner storing means is supplied with the air one after another when the air generation means are driven.

25. The multicolor image forming apparatus according to claim 24, wherein said air generating means include air storing means for temporarily storing air.

26. The multicolor image forming apparatus according to claim 24, wherein said air supply controlling means control driving of the air generating means and opening and closing of the plurality of the air guiding means in such a maimer that the plurality of toner storing means are supplied with air one after another when the air generating means are driven and the air storing means are filled with air.

27. The image forming apparatus including toner replenishing means for replenishing developing means with toner stored in toner storing means, said toner replenishing means comprising:

toner guiding means for guiding toner from the toner storing means to the developing means;

toner conveying means for conveying the toner from the toner storing means to the developing means along the toner guiding means; and air supplying means for supplying the toner storing means with air from a bottom of the toner storing means, wherein said air supplying means are connected to the toner guiding means and are connected to the toner conveyance means and include air supply control means for controlling supplying of air to the toner storing means and a smaller number of air generation means for generating air than said toner storing means.

28. The image forming apparatus according to claim 27, wherein said toner storing means include evacuation means for evacuating the air from the toner storing means.

* * * * *